US005478070A

United States Patent [19]

Morrison

[11] Patent Number: 5,478,070

[45] Date of Patent: Dec. 26, 1995

[54] BALL AND BAT TRAINER TEE AND GUIDE ASSEMBLY

[76] Inventor: Howard J. Morrison, 610 Juneberry Rd., Riverwood, Ill. 60015

[21] Appl. No.: 391,455

[22] Filed: Feb. 21, 1995

[51] Int. Cl.[6] ..... A63B 69/40

[52] U.S. Cl. ..... 273/26 R

[58] Field of Search ..... 273/26 R, 191 R, 273/192

[56] References Cited

U.S. PATENT DOCUMENTS

| | | | |
|---|---|---|---|
| 2,985,452 | 5/1961 | Trippet | 273/26 R |
| 3,475,026 | 10/1969 | Cooper | 273/26 R |
| 3,904,199 | 9/1975 | Burchett | 273/26 R |
| 3,937,464 | 2/1976 | Zalewski | 273/26 R |
| 3,940,131 | 2/1976 | Claire, Jr. | 273/26 R |
| 4,516,771 | 5/1985 | Nau | 273/26 R |
| 4,783,070 | 11/1988 | Bauer | 273/26 R |
| 4,927,152 | 5/1990 | Graham | 273/191 R |

*Primary Examiner*—Theatrice Brown

*Attorney, Agent, or Firm*—Michael Ebert

[57] ABSTRACT

A trainer tee and guide assembly that creates a target zone leading a bat swung by a player toward a ball placed at a fixed elevated position above ground. The acceptance angle of the target zone is adjustable to accommodate different angles of swing as the player gains greater skill in the course of training. The assembly includes a U-shaped frame having upper and lower horizontal branches whose free ends terminate in vertically-separated blocks between which the ball is placed, the frame being raised to place the ball at a level appropriate to the height of the player. Pivoted on the blocks are upper and lower guide arms which extend laterally to the left or right of the blocks to define a target zone whose angle of acceptance depends on the angular orientation of the arms. The arms are angularly adjustable to vary the acceptance angle in a range going from a low skill angle in which the arms diverge in opposite directions about 45 degrees from the horizontal to accommodate large angle swings of the bat, to a high skill angle in which the arms are nearly parallel to each other to accommodate a level swing of the bat affording maximum power.

9 Claims, 4 Drawing Sheets

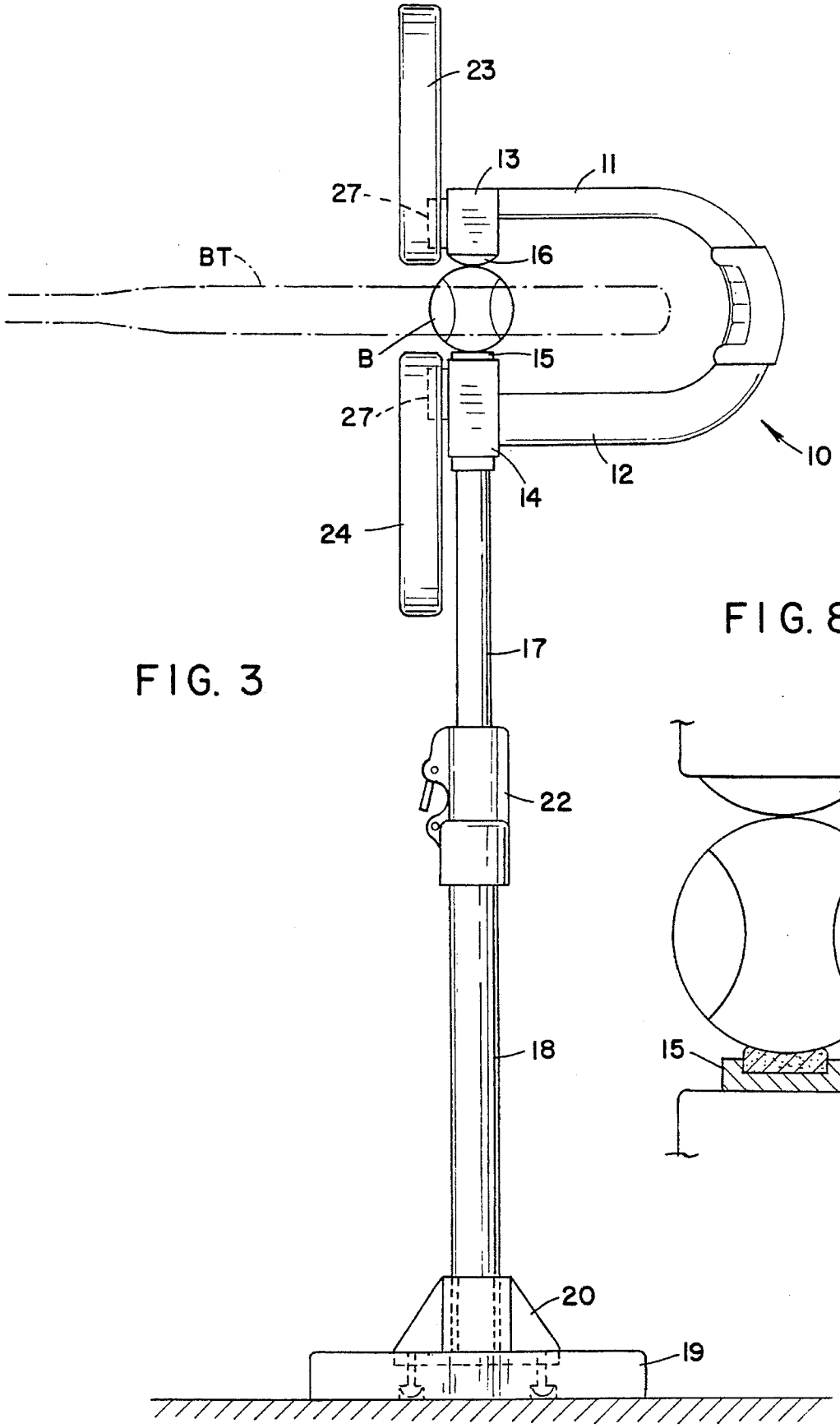
FIG. 3
FIG. 8
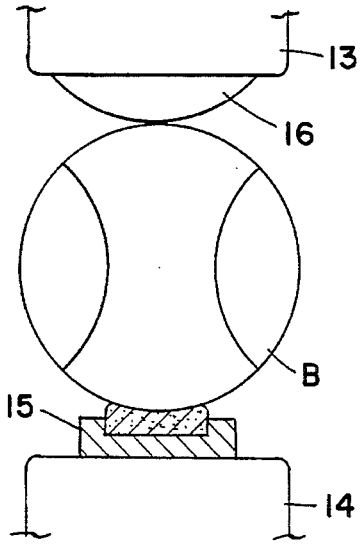

BALL AND BAT TRAINER TEE AND GUIDE ASSEMBLY

BACKGROUND OF INVENTION

1. Field of Invention

This invention relates generally to practice devices for training a player how best to swing a bat to hit a ball, and more particularly to a trainer tee and guide assembly which creates a target zone leading a bat swung by a player toward a ball placed in a tee at an elevated position, the acceptance angle of the target zone being adjustable to accommodate different angles of swing in the course of training as the player gains greater skill.

2. Status of Prior Art

Baseball is our national game and many players learn to play at a very early age, using for this purpose a light weight bat and a soft, foam plastic ball rather then a relatively heavy and hard standard baseball.

Teaching a six-year-old child how to hit a ball with a bat is not an easy task. If you, as the child's trainer, act as a pitcher, you then try to aim the ball so that it reaches the child at his hitting side at about the level his chest so that the child, by swinging the bat, can connect with the oncoming ball. The hitting side of the player depends on whether he is right or left-handed.

It is not only difficult for an individual trainer, such as a parent who lacks pitching skills, to throw a ball so that it reaches a child holding a bat at a proper level, but it is even more difficult for a child who is a novice and has yet to develop the proper eye and hand coordination for this purpose, to strike a moving ball with a bat.

In order, therefore, to dispense with the need for a pitcher, trainer tees have been devised that place a ball at a fixed position above ground at a level appropriate to the height of the child being trained. Thus the Hardison U.S. Pat. No. 5,322,276 discloses a tee supporting a baseball at a desired elevation above ground so that it can be struck by a batter. Also included in the Hardison trainer is a guide bar directing the swinging bat toward the ball.

In training a Flayer to hit a ball with a bat, one must bear in mind that maximum hitting power is attained when the swing path is level with the ball. Some training devices are, therefore, designed to assist the batter in perfecting a level swing. Thus the St. Claire U.S. Pat. No. 3,940,131 discloses a device that includes a U-shaped frame having parallel upper and lower horizontal arms with the ball placed on the loser arm. To hit the ball, the batter must swing his bat so that it sweeps between the parallel arms and is, therefore, level with the ball. Should the swing be angled with respect to the ball, the bat will strike one of the arms, rather than the ball.

In the training device shown in the Laseke U.S. Pat. No. 5,087,039, a lower horizontal arm is provided on which the ball to be hit is supported, the height of the lower arm being adjustable so that it can be set at a desired elevation. Above the lower arm is a horizontal upper arm of adjustable height to define a zone between the parallel arms which can be widened or narrowed in the course of training to promote a level bat swing.

The drawback of those training devices which create between parallel arms a level swing zone is that at the outset of training, a novice player find it difficult to produce a level swing and all too often swings his bat in a path at an acute angle to the horizontal line. As a consequence the bat would strike and possibly damage the training device.

SUMMARY OF INVENTION

In view of the foregoing, the main object of the invention is to provide a trainer tee and guide assembly which makes it possible for a novice player to practice hitting a ball with a bat, the assembly creating a target zone leading to the bat having an acceptance angle which is adjustable whereby in the course of training this acceptance angle may be varied to accommodate different angles of swing.

More particularly, an object of this invention is to provide an assembly of the above type that includes a pair of guide arms which define the target zone, the arms being angularly adjustable in a circular pattern so that they can be extended to the right or left to create a target zone suitable for either a right or left handed hitter.

A significant feature of the assembly in accordance with the invention which includes a tee on which the ball to be hit is placed, is that the elevation of the tee is adjustable to a level appropriate to the height of the player.

Also an object of the invention is to provide a trainer tee and guide assembly adapted to train a child in how best to swing a bat to hit a ball placed on a tee, the assembly because it is stable and adjustable in height, being also useable as a practice device for older and taller players.

Briefly stated, these objects are attained in an assembly that includes a U-shaped frame having horizontal branches whose free ends terminate in vertically-spaced blocks between which is placed a ball to be hit, the lower block being mounted on top of a vertical post telescoped in a tubular stand anchored on a ground base. The stand is provided with a releasable latching mechanism to lock the post at a position placing the ball at an elevation appropriate to the height of the player.

Pivoted on the blocks ,are upper and lower guide arms that are rotatable in a circular pattern and are angularly adjustable to define a target zone extending laterally from the blocks to the right or left thereof leading to the ball. The arms are angularly adjustable to vary the acceptance angle of the target zone in the course of training from a low skill angle in which the arms are angled about 45 degrees from the horizontal to accommodate large angle swing of the bat to a high skill angle in which the arms are nearly parallel to accommodate a level swing the bat affording maximum power.

BRIEF DESCRIPTION OF DRAWINGS

For a better understanding of the invention as well as other features thereof, reference is made to the detailed description of the invention to be read in conjunction with the accompanying drawing wherein:

FIG. 3 is an end view of the assembly;

FIG. 8 shows how the ball is placed between the blocks.

DESCRIPTION OF INVENTION

Figure 1:
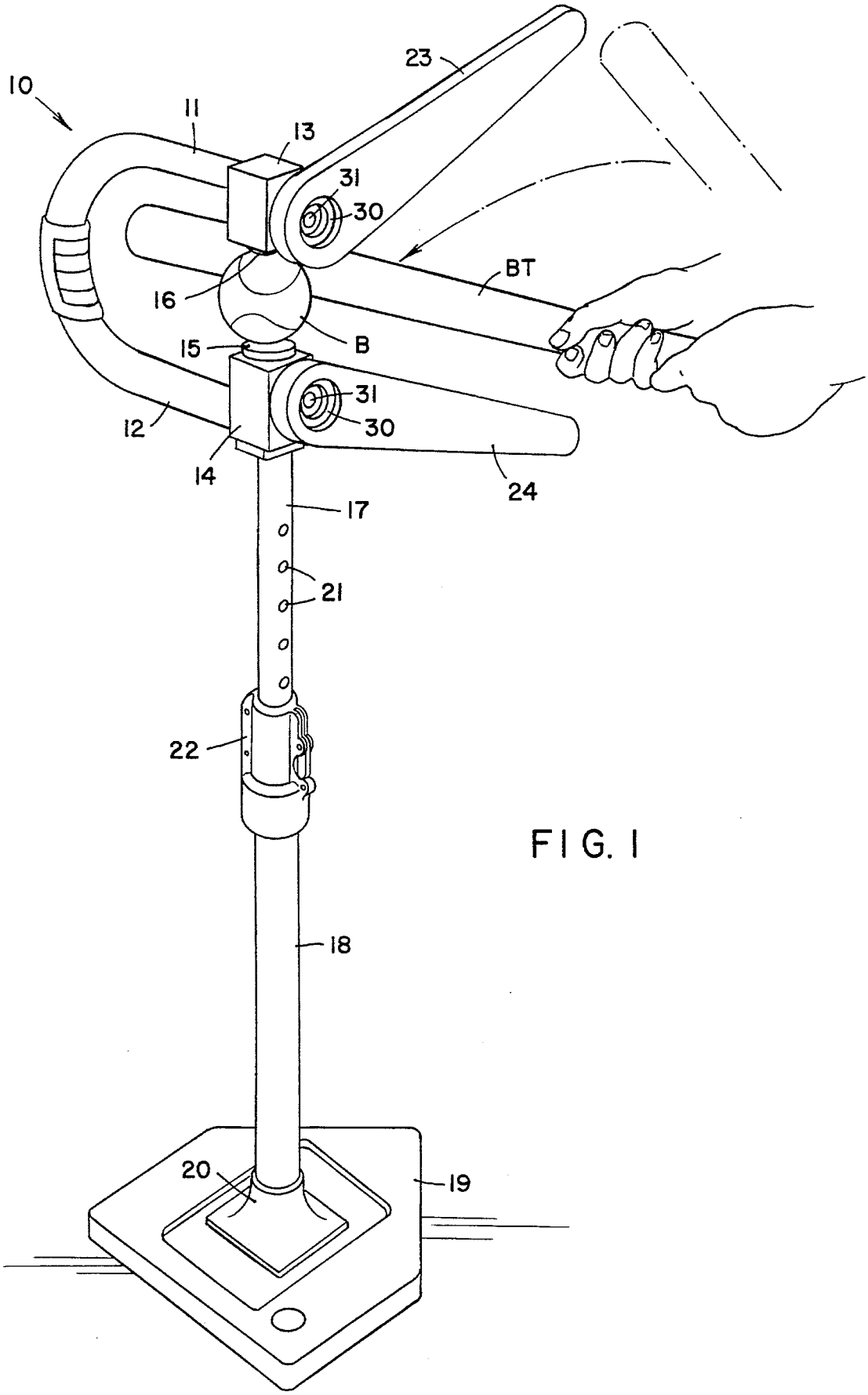
FIG. 1 is a perspective view of a trainer tee and guide assembly in accordance with the invention.
Figure 2:
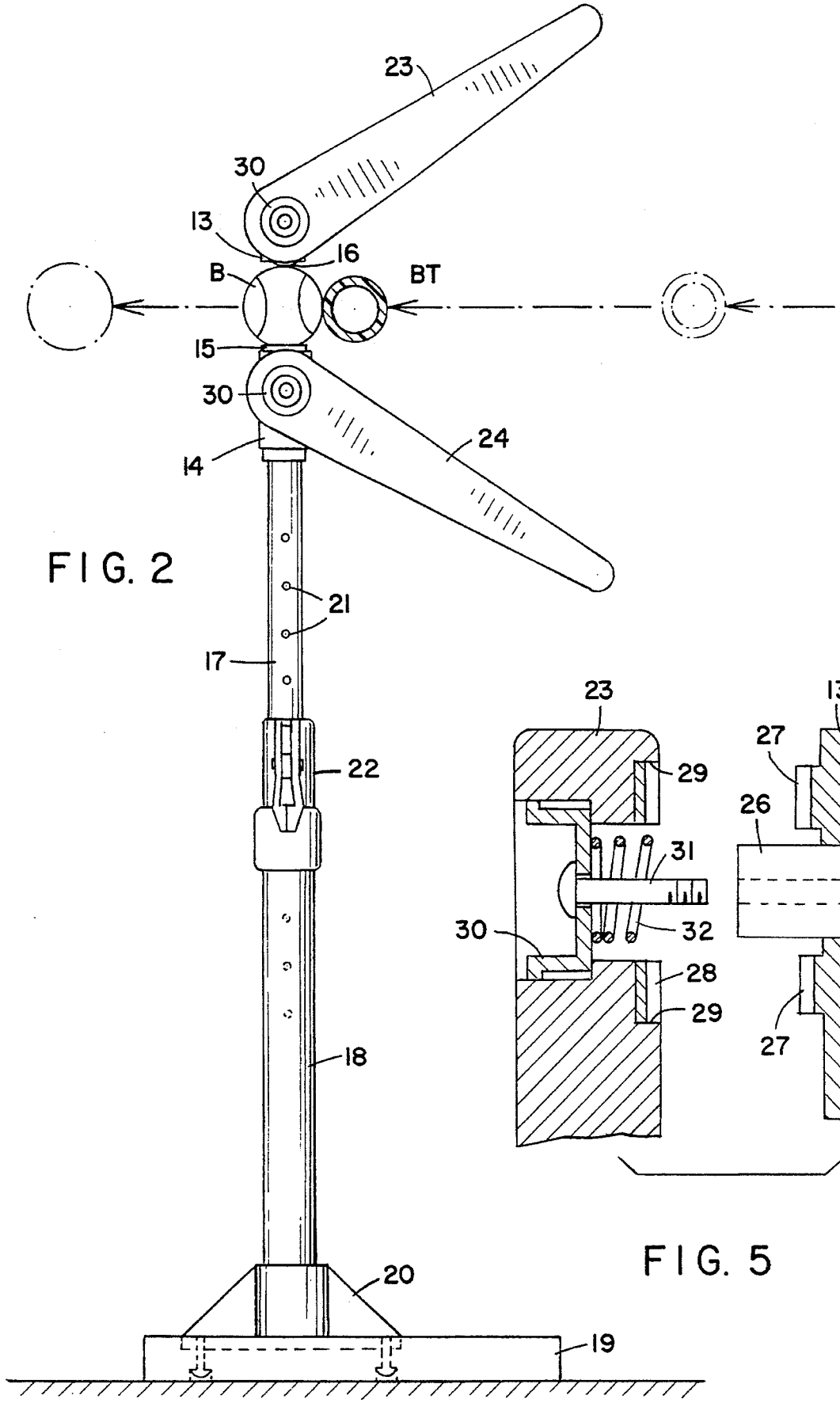
FIG. 2 is a side view of the assembly.

Referring now to FIGS. 1, 2 and 3 which illustrate a preferred embodiment of a trainer tee and guide assembly in accordance with the invention, the tee placing a ball B at an elevation above ground appropriate for the height of the player being trained, the assembly includes a U-shaped frame 10 having upper and lower horizontal branches whose free ends terminate in blocks 13 and 14 acting as a tee between which the ball B is placed.

As shown in FIG. 8, the lower block 14 is provided at its top and with a small concave cup 15 to receive the south pole of ball B, while the upper block 13 is provided at its bottom end with a convex protuberance 16 which engages the north pole of the ball. For training a young child, ball B is preferably a flexible foam plastic ball that is compressible so that it can be squeezed between the upper and lower blocks and held temporarily in place until it is struck by a ball.

If a standard baseball is used for practice, the ball rests on cup 15, the convex protuberance 16 then touching the north pole of the ball. In training a child to hit, a flexible foam plastic ball is preferable for the purpose, the child may then be provided with a light weight bat BT rather than a standard baseball bat having a broader striker section.

The lower block 14 of the tee is mounted on the end of a hollow vertical post 17 telescopically received in a tubular stand 18 anchored by a pedestal 20 on a ground base 19 by means of a pedestal 20 to form a stable assembly. Post 17 is provided with a row of equi-spaced holes 21 along its length which cooperate with a releasable latching mechanism 22 mounted on the upper end of stand 18. The mechanism is provided with a retractable lug (not shown) that is insertable in a selected hole 21 to lock the post at a desired extended position relative to the stand, thereby elevating the tee to a level appropriate to the height of the player being trained to hit the ball.

Figure 5:
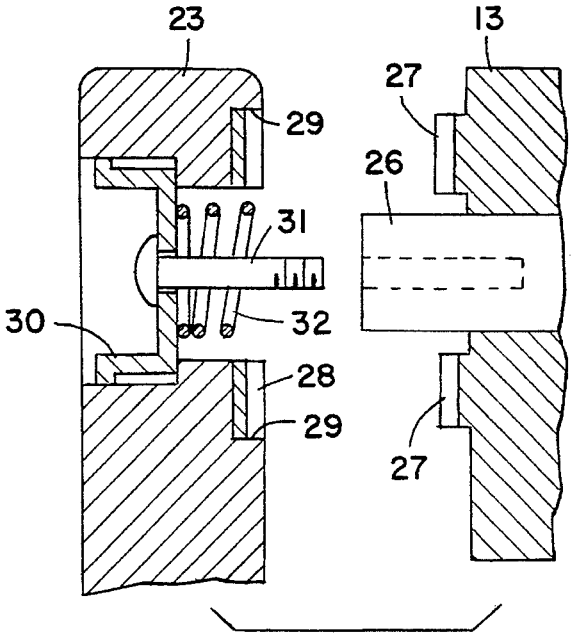
FIG. 5 shows how one of the arms is coupled by a rotary hinge to a related block.
Figure 4:
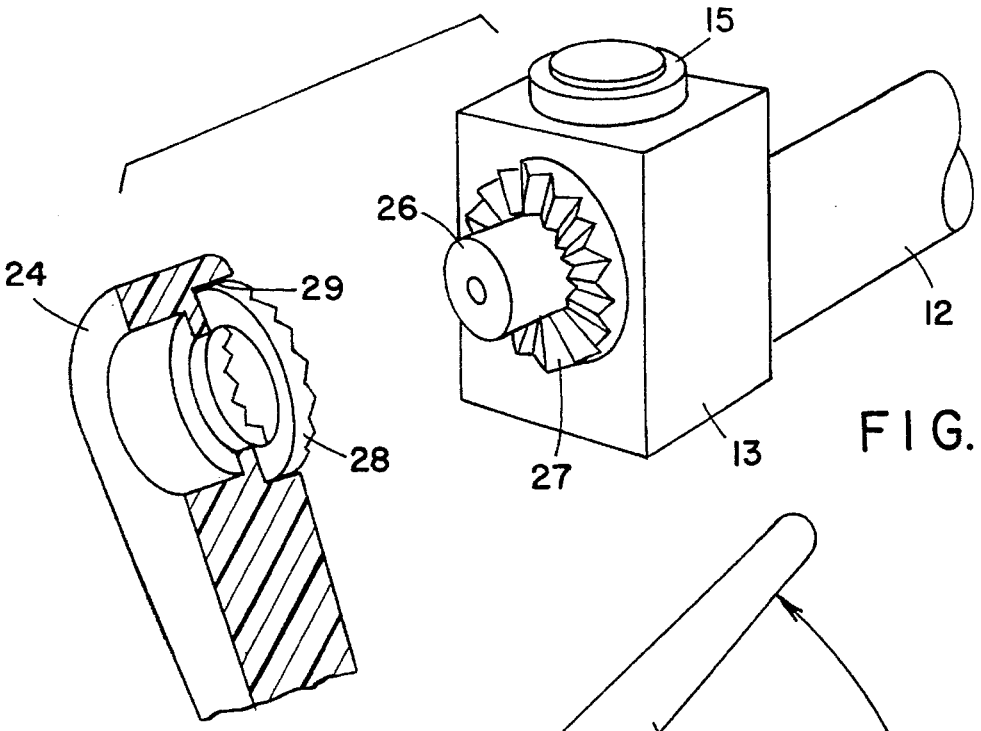
FIG. 4 shows the face of one block from which the axle of a rotary hinge projects.

Pivoted on the upper and lower blocks 13 and 14 by rotary hinges are tapered guide arms 23 and 24 having rounded free ends. As shown in FIGS. 4 and 5 in connection with block 13 and arm 14, each rotary hinge includes an axle 26 which is anchored in the related block and projects from the front face thereof. Attached to the face of the block is a ring 27 provided with a circular array of ratchet teeth. The arm pivoted on the block is provided with a complementary ratchet ring 28 which is nested in a circular well 29 formed in the inner side of the arm. As best seen in FIGS. 1 and 5, received in a circular cup 30 nested in the outer side of the arm is a screw 31 that is threadably received in axle 26 projecting from the block.

Interposed between axle 26 and cup 30 is a helical metal spring 31 which surrounds screw 31 to provide a resilient coupling between the complementary ratchet rings 27 and 28 whose teeth intermesh whereby the arm may be rotated to cause the teeth of the ratchet ring in the arm to ride over the teeth of the ring on the block. The arm, therefore, may be turned in a circular path to assume any desired angle relative to the block on which it is pivoted.

Thus by setting the arms 23 and 24 as shown in FIG. 2 so that they both extend to the right of blocks 13 and 14 on which they are pivoted, with the upper arm 23 raised about 25 degrees above the horizontal plane passing through its pivot point and with lower arm 24 lowered the same number of degrees below the horizontal plane passing through its pivot point, one then creates a target zone having a fairly wide angle of acceptance to accommodate a bat BT swing by a player toward ball B placed between the blocks at the site at which the arms converge.

In order, therefore, for the bat to strike the ball at the site, the swing path of the bat must pass within the angle of acceptance of the target zone and lead toward the ball and not strike either arm. Hence the adjusted angle of acceptance determines the limits of the bat swing range.

OPERATION

We shall assume that the player using the trainer tee and guide assembly is a novice with little experience in hitting a ball with a bat, such as a young child handling a bat for the first time. The assembly must, therefore, be set so that the tee on which ball B is placed between the upper and lower blocks on the branches of the frame is at a level appropriate to the height of the child. The preferred level is one that is aligned with the chest of the player. Hence when the child swings the bat so that the swing is level with his chest, it is also then level with the ball and, therefore, is a level swing resulting in maximum hitting power.

Figure 6:
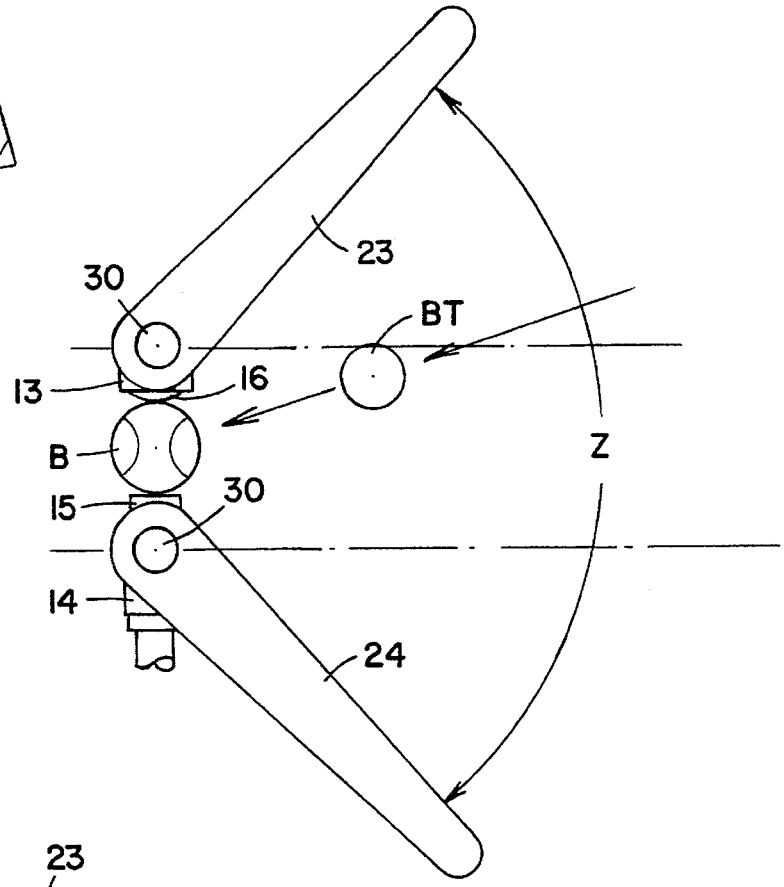
FIG. 6 illustrates a wide target zone.
Figure 7:
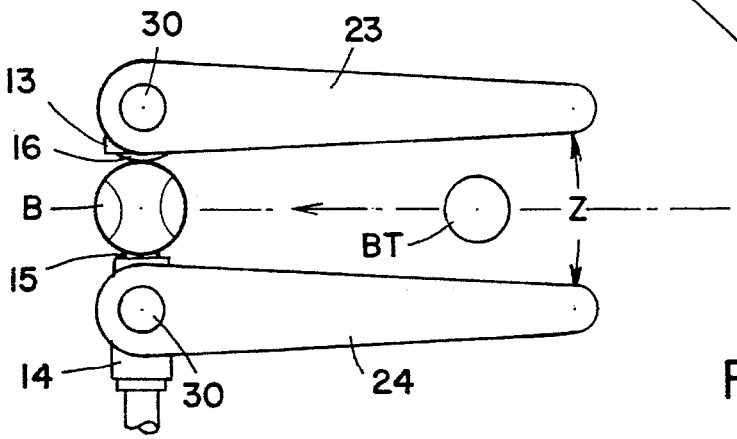
FIG. 7 illustrates a narrow target zone.

Arms 23 and 24 are extended in a lateral direction from the blocks in a direction that depend on whether the child is left or right handed. In FIGS. 6 and 7, the arms are shown extended to the right to create a target zone Z leading to ball B placed on the tee. Since the arms are rotatable in a circular path, when the child is left-handed, the arms may then be extended to the left of the blocks.

In FIG. 6 in order to accommodate the assembly to a child who is a novice at hitting a ball with a bat, the upper arm 23 is set to assume on angle of about 45 degrees above the horizontal plane passing through its pivot axis, and the lower arm 24 is set to assume an angle of 45 degrees below the horizontal plane passing through its pivot axis, thereby creating a very wide angle of acceptance for the target zone Z. As a consequence, a child swinging a bat BT can do so within a broad range of swings and still fall within the limits of the large zone to strike the ball and avoid the arms.

At the outset of a training program, a novice player as long as he is able to swing the bat so that it always sweeps within the limits of the target zone Z will always succeed in striking the ball. But the greater the degree to which the swing deviates from a level swing, the weaker the striking power of the bat.

When the player is able to strike the ball with repeated swings, the player is then ready for the next step in training which involves a somewhat narrower angle of acceptance for the target zone. This compels the player to bring his swing closer to a level swing, the closer it is the greater the hitting power of the bat.

In practice, therefore, the angle of acceptance of the target zone is reduced in progressive steps. By changing the angle of the arms from 45 degrees to 35 degrees, then from 35 degrees to 25 degrees, and then from 25 degrees to 15 degrees, this makes it more difficult with each new setting for the player to swing the bat so that it sweeps within the target zone and avoids the arms.

As the novice player gains in skill in handling the bat, a point is reached in the training program where the player is put to the final test which requires the player to produce a level swing affording maximum hitting power. To this end, as shown in FIG. 7, arms 23 and 24 are set so that they are nearly in parallel relation to create a narrow angle of acceptance that will accommodate only a swing that is substantially level with the ball.

When the novice player succeeds in swinging the bat to produce a level swing, he then satisfies the basic requirement for being a good hitter. But it is not enough for the player to just once produce a level swing, for he must be able to do so repeatedly without striking the arms of the assembly.

The advantage of a trainer tee and guide assembly in accordance with the invention is that it dispenses with the need for a pitcher to train the player and it effects a progressive improvement in the ability of the player to hit the ball in a way that is most effective in driving the ball.

While there has been shown a preferred embodiment of a ball and bat trainer tee and guide assembly in accordance with the invention, it is to be understood that many changes may be made therein without departing from the spirit of the invention.

I claim:

1. A trainer tee and guide assembly for training a player how best to hit a ball with a bat, said assembly comprising:

A. a U-shaped frame acting as a tee to place a ball at an elevated level above ground appropriate to the height of the player, said frame having upper and lower branches whose free ends terminate in vertically-separated upper and lower blocks between which the ball is placed; and B. upper and lower arms hinged to corresponding blocks and extending laterally therefrom to create a target zone leading to the ball, said arms being angularly adjustable to define a target zone angle of acceptance whose size determines the limits of the range of bat swings which are admissible into the zone to connect with the ball.

2. An assembly as set forth in claim 1, in which the lower block is provided at its top end with a concave depression to receive a lower Dole of the ball.

3. An assembly as set forth in claim 2, in which the upper block is provided at its bottom end with a convex protuberance to engage an upper pole of the ball.

4. An assembly as set forth in claim 3, in which the ball is spherical and is formed of flexible foam plastic material, the diameter of the ball being such relative to the space between the concave depression and the convex protuberance that the ball is squeezed therebetween to hold it in place.

5. An assembly as set forth in claim 1, in which the lower block is mounted on top of a vertical post telescoped in a tubular stand anchored on a ground base, the post being extended relative to the stand to elevate the ball to a level appropriate to the player.

6. An assembly as set forth in claim 5, further including a releasable latching mechanism mounted on the stand to lock the post at a desired extension.

7. An assembly as set forth in claim 1, in which the arms are hinged to the blocks by rotatable hinges whereby the arms may be extended laterally from the blocks to either the left or right thereof to define a target zone for either a left handed or a right handed player.

8. An assembly as set forth in claim 7, in which the hinges are provided with a ratchet mechanism which holds the angularly adjustable arms at any set angle.

9. A method for training a player how best to hit a ball with a bat comprising the steps of:

A. placing the ball on a tee to elevate it above ground at a level appropriate to the height of the player;

B. creating with a pair of angularly adjustable arms extending laterally from the tee a target zone which leads to the ball, the target zone having an angle of acceptance whose size is determined by the angular orientation of the arms;

C. and varying the size of the angle of acceptance in the course of a training program so that it is at first very wide to admit bat swings within a broad range of angles, the size being thereafter progressively narrowed until finally the arms are close to being parallel to admit only a level swing of the bat to contact an upper pole of the ball.

* * * * *